US006629439B2

(12) United States Patent
Wöbkemeier

(10) Patent No.: US 6,629,439 B2
(45) Date of Patent: Oct. 7, 2003

(54) LAUNDRY TREATMENT MACHINE

(75) Inventor: Martina Wöbkemeier, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 258 days.

(21) Appl. No.: 09/873,096

(22) Filed: Jun. 1, 2001

(65) Prior Publication Data

US 2001/0042391 A1 Nov. 22, 2001

Related U.S. Application Data

(63) Continuation of application No. PCT/EP99/09220, filed on Nov. 26, 1999.

(30) Foreign Application Priority Data

Dec. 1, 1998 (DE) ..... 198 55 503

(51) Int. Cl.[7] ..... D06F 33/02
(52) U.S. Cl. ..... 68/12.02; 68/12.27
(58) Field of Search ..... 68/12.01, 12.02, 68/12.18, 12.19, 12.12, 12.16, 12.27

(56) References Cited

U.S. PATENT DOCUMENTS 5,388,299 A * 2/1995 Lee
5,644,936 A * 7/1997 Yasutake et al.
5,715,555 A * 2/1998 Reber et al.
5,969,606 A * 10/1999 Reber et al.
6,253,076 B1 * 6/2001 Boesch
6,463,940 B1 * 10/2002 Thomas et al.

* cited by examiner

*Primary Examiner*—Frankie L. Stinson
(74) *Attorney, Agent, or Firm*—Laurence A. Greenberg; Werner H. Stemer; Ralph E. Locher

(57) ABSTRACT

A laundry treatment machine, in particular, a washing machine and/or drier, includes an electronic controller, an information output device, and an input device. The electronic controller automatically implements laundry programs and has a decision-maker identifying each laundry item placed therein. The decision-maker makes decisions to create an optimized treatment program for treating the combination of identified laundry items placed into the machine. An information output device presents to a user the optimized program as a proposal. An input device is connected to the electronic controller and is to be actuated by a user for confirming the laundry treatment program determined by the decision-maker.

34 Claims, 3 Drawing Sheets

LAUNDRY TREATMENT MACHINE

CROSS-REFERENCE TO RELATED APPLICATION

This application is a continuation of copending International Application No. PCT/EP99/09220, filed Nov. 26, 1999, which designated the United States.

BACKGROUND OF THE INVENTION

Field of the Invention

The invention lies in the field of household appliances. The invention relates to a laundry treatment machine with an electronic control device for the automatic implementation of laundry treatment programs.

A laundry treatment machine may include, in particular, a washing machine, a laundry drying machine, or a combined washing and drying machine. Such machines are generally in the prior art.

Furthermore, depending on the material of the items of laundry, the items can be subjected to different degrees of mechanical loading, can be heated only up to a certain temperature, and/or must not be treated with certain chemical substances. Depending on the degree to which the items are soiled or the type of their soiling, items of laundry should be treated differently. On one hand, the items of laundry should be treated as gently as possible, while, on the other hand, their soiling should be removed as completely as possible. Another important parameter is the energy required for the treatment of the laundry. As little energy as possible should be required for such treatment. A further criterion is the time period for the treatment of the laundry, which should be as short as possible. The prior art washing machines include a large number of washing programs and other laundry treatment programs, for example, drying programs, from which an operator can choose a program that, in the user's own judgement, is the most suitable for the laundry to be treated. To make such a determination, the operator requires considerable knowledge and experience for judging what material is relevant to the items of laundry to be treated and which type of soiling of the items of laundry is at issue. If an item of laundry has no label indicating its material and the type of permissible laundry treatment, it is often not possible for an operator to identify the type of material of the item of laundry and to determine the permissible treatment process or washing process. Also, in the case of stains, an operator often cannot identify which type of soiling is present.

In the days before washing machines and laundry dryers, and before there were so many different types of fabric and types of detergent for laundry, the operator was directly involved with the laundry. The person was able to "test" the laundry. He or she also knew exactly which item of laundry could be subjected to greater or lesser degrees of mechanical loading, for example, when wringing out the laundry after the laundering operation. The wringing out of the laundry corresponds today to the spinning in a washing machine or in a drier.

Today, the operator is separated from the laundry by the washing machine. He or she can only set a certain program. According to the program set, the entire laundry treatment takes place either completely correctly or completely incorrectly or partly correctly.

SUMMARY OF THE INVENTION

It is accordingly an object of the invention to provide a laundry treatment machine that overcomes the hereinaforementioned disadvantages of the heretofore-known devices of this general type and that treats items of laundry more gently, with less energy, and in an optimized time without the operator needing to have special knowledge concerning the type of the items of laundry.

With the foregoing and other objects in view, there is provided, in accordance with the invention, a laundry treatment machine, including an electronic control device for automatic implementation of laundry treatment programs having a decision-making means for identifying a type of each laundry item placed into the laundry treatment machine and making a decision concerning an optimized laundry treatment program of a plurality of laundry treatment programs to be used for treating a combination of the identified laundry items placed into the laundry treatment machine, information output means for presenting to a user the optimized laundry treatment program as a proposal, the information output means connected to the decision-making means, and input means connected to the electronic control device, the input means to be actuated by a user for confirming the laundry treatment program determined by the decision-making means.

According to the invention, a possible way of identification and communication is to be created between the operator, the laundry treatment machine, and the items of laundry to be treated, thus assisting the operator in making a decision concerning good laundry treatment by the laundry treatment machine.

Within the scope of the invention, "type of items of laundry" can be understood as meaning not only the type of material, type of fiber, and type of dyes of the items of laundry to be treated, but also the type and degree of their soiling, depending on how the control device of the laundry treatment machine is constructed.

For example, within the scope of the invention, the control device or the decision-making device of the laundry treatment machine may have stored the following parameters of the items of laundry, which it takes into consideration when determining a laundry treatment program: types of fabric, types of soil, permissible temperatures, treatment duration, the amount and type of treatment water, detergent, rinsing agent. etc.

The decision-making device is combined with the electronic control device. It may be disposed separately from the latter, or be formed partly or completely by the electronic control device, or be integrated in the latter. The decision-making device identifies the type of the items of laundry and calculates for the identified items of laundry an optimum laundry treatment program (washing program and/or drying program and/or other laundry treatment operations).

As a result, laundry is treated with a program optimized for the laundry even if the operator has no detailed knowledge concerning the type of fabric and/or the type of soiling of the items of laundry.

The operator need only present the items of laundry to a detecting device or a measuring head of the decision-making means and then load them into the laundry treatment machine. Then, after all the desired items of laundry have been loaded, the operator closes the laundry treatment compartment of the machine and gives it a starting command. The control device is preferably configured to start the laundry treatment program only when the laundry treatment compartment is closed, for example, in the case of a washing machine, the door of the washing drum is closed.

In accordance with another feature of the invention, a communication system is provided, by which the decision-making device can communicate with a person. Depending on the embodiment, information output of the decision-making device may be optical and/or acoustic, for example, a voice output. The information to be conveyed by a person can be entered in the communication system manually and/or by speech, depending on its embodiment.

In accordance with a further feature of the invention, decision-making device not only permits a "YES" or "NO" decision to be possible, by confirming or canceling a laundry treatment program proposed by the machine, but the possibility of a person modifying the laundry treatment program proposed by the decision-making device and starting it in a modified form is also provided.

In accordance with an added feature of the invention, the input means includes a selection device modifying the optimized laundry treatment program and executing the modified laundry treatment program.

The decision-making device may be configured to propose one of the laundry treatment programs that are stored in the electronic control device, or to generate an individual laundry treatment program based on the type of the items of laundry identified. Such an individually generated laundry program may include parts of the stored laundry treatment programs.

In accordance with an additional feature of the invention, the decision-making means selectively sets a stored laundry treatment program and generates a custom laundry treatment program individually adapted to at least one identified laundry item and proposes the custom laundry treatment program to the user.

In accordance with yet another feature of the invention, the decision-making device forms clusters concerning the frequency with which identified items of laundry that correspond to predetermined parameters occur. These parameters are stored in the control device or the decision-making device and are, for example, types of fabric or types of fiber and/or types of soil that may be present in the laundry items. The decision-making device checks, for each identified item of laundry, which of the parameters also apply to the item of laundry.

In accordance with yet a further feature of the invention, the decision-making device calculates from the clusters the laundry treatment program suitable for the items of laundry identified.

In accordance with yet an added feature of the invention, the decision-making device is preferably configured to calculate from the clusters based on fuzzy logic the decision as to which laundry treatment program can be used for treating the items of laundry identified.

In accordance with yet an additional feature of the invention, the decision-making device preferably includes a spectrometer for identifying the type of the items of laundry.

In accordance with again another feature of the invention, to identify the items of laundry, they can be placed manually one after the other in front of a measuring head or sensor of the decision-making device. The measuring head may be fixedly disposed on the laundry treatment machine or be a hand-held device. Depending on the technical configuration, the measuring head can pick up information from the item of laundry in question concerning the type of the item of laundry, for example, its type of fiber, and concerning the type of its soiling, either by contact or without contact. The measuring head may be connected to the electronic control device or its decision-making device by a cable or by radio link.

In accordance with again a further feature of the invention, the decision-making device preferably has a display device to optically display the type of the item of laundry identified. Such display allows an operator to "learn" the type of fabric or fibers of the item of laundry identified.

In accordance with again an added feature of the invention, the display device is configured to indicate separately for each type of laundry item the number of these items of laundry per type. Such indication has several advantages. Items of laundry can be washed or dried at a different maximum temperature, according to their fabric type. The mechanical strength of the items of laundry is likewise dependent on their type of fabric. Thus, for example, higher or lower rotational speeds or more frequent changes in the direction of rotation or pauses in rotation of a laundry treatment drum, for example, of a laundry drum, a spin drier, or a laundry drier, are permissible, based upon the type of fabric of the item of laundry. When a number of items of laundry are being treated at the same time, the temperature and the mechanical treatment of the items of laundry are governed by the item of laundry that has the lowest temperature tolerance and lowest mechanical stress tolerance. Taking these parameters into consideration, the time duration of a suitable laundry program can also be lengthened or shortened. An optical or acoustic or written or other indication to the operator as to the type of the items of laundry and the number of items of laundry per type by the laundry treatment machine gives the operator the possibility of taking back again one or more identified items of laundry and having a new laundry treatment program proposed by the control device or its decision-making device. Preferably, other parameters, for example, chemical laundry treatment agents, fabric softeners, spinning speed, etc., can also be influenced by an operator.

In accordance with again an additional feature of the invention, the decision-making device has a switchable sensor or switchable measuring head or an additional sensor or additional measuring head with a respective evaluation device. The evaluation device subtracts from the identified items of laundry those items of laundry presented to it once again by the operator. As a result, it is no longer necessary for an operator to have all the items of laundry newly identified if he or she takes one or more items of laundry away from the items of laundry identified, such that a new laundry treatment program is calculated by the decision-making device. A measuring head or sensor that adds or subtracts the items of laundry to or from the decision-making process according to the direction of movement of an item of laundry in relation to it can also be used.

In accordance with a concomitant feature of the invention, the laundry treatment machine is a washing machine, a drying machine, or a combination washing and drying machine.

Other features that are considered as characteristic for the invention are set forth in the appended claims.

Although the invention is illustrated and described herein as embodied in a laundry treatment machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
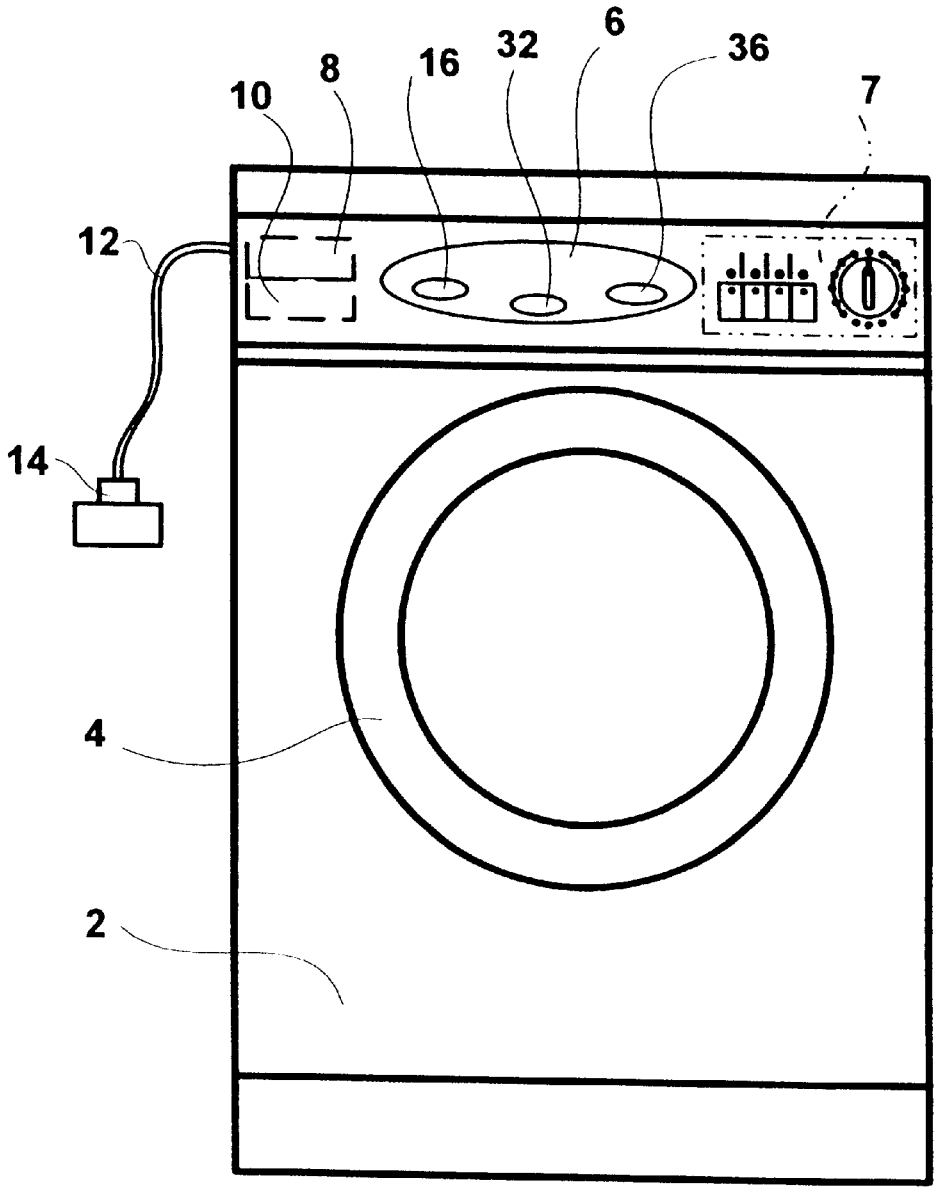
FIG. 1 is a diagrammatic front view of a laundry treatment machine according to the invention.

In all the figures of the drawing, sub-features and integral parts that correspond to one another bear the same reference symbol in each case.

For the following description, it is assumed that the laundry treatment machine is a washing machine. However, it could also be a laundry drier or a combined washing and drying machine.

Referring now to the figures of the drawings in detail and first, particularly to FIG. 1 thereof, there is shown a washing machine 2 including on the front side a door 4 for closing a rotatable laundry drum. Also on the front side is a display device 6 with a plurality of display zones or display areas for the optical display of machine functions, in particular, washing programs, and information on the current program status and the type of identified items of laundry. Furthermore, an operator control device 7 with a large number of manual operator control elements (buttons, switches) for operating the washing machine 2 is disposed on the front side. In the washing machine, there is an electronic control device 8 with an electronic decision-making means or electronic decision-maker 10. The control device 8 and its decision-maker 10 may have permanently integrated or variable laundry treatment programs and a storage device or means for storing a large number of parameters. The parameters are, in particular, data for detecting and identifying types of fabric of items of laundry and types and degrees of soiling of the items of laundry and data on how many different types of items of laundry and different types of soiling can be treated by a washing program and/or a drying program. Such parameters also include data on permissible treatment temperatures, treatment time periods, and data on chemical, inorganic, or organic agents for treating the items of laundry and their soiling.

The decision-maker 10 is connected by a flexible cable 12 to a sensor or to a measuring head 14, with which items of laundry that are manually presented to the measuring head 14 by an operator can be scanned without contact or by contact, depending on a technical configuration. The decision-maker 10 identifies the items of laundry detected by the measuring head 14 and calculates, from the measured data and the stated parameters, which washing program the identified items of laundry can be washed and/or dried together at the same time.

Figure 2:
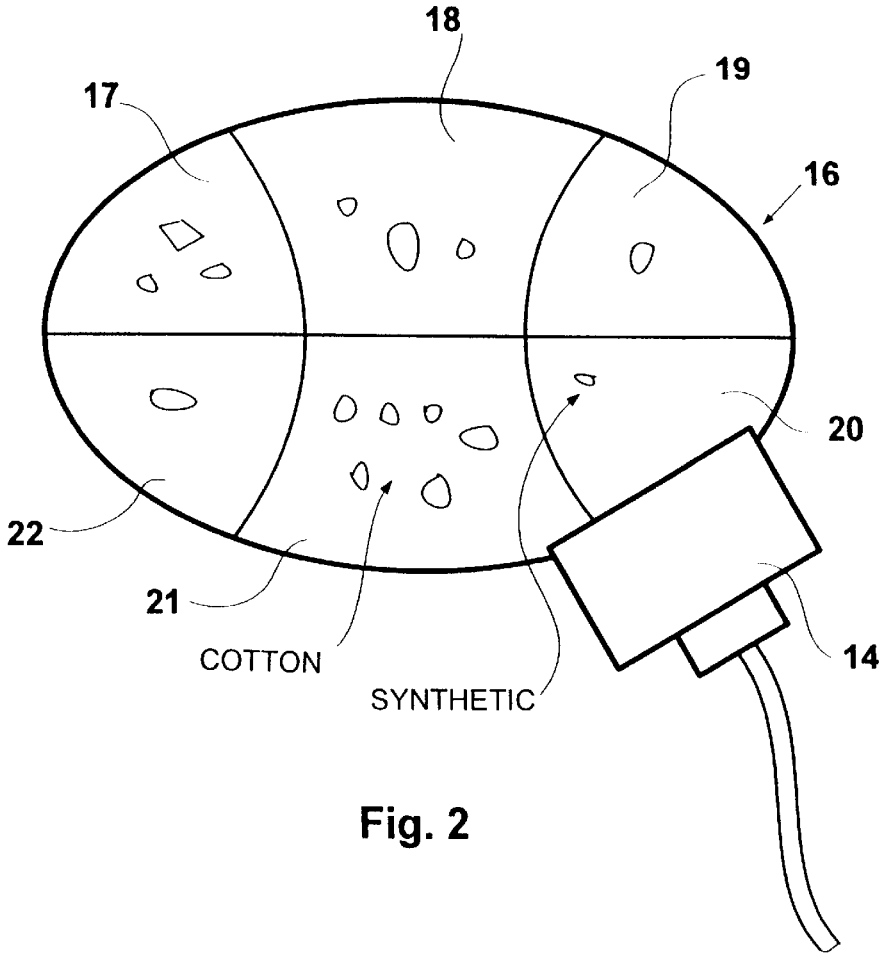
FIG. 2 is a diagrammatic illustration of a display device of the laundry treatment machine according to FIG. 1 with display zones for indicating the type of fabric of identified items of laundry and, for each type, the number of items of laundry identified.

According to a preferred embodiment, the display device 6 displays the values of the items of laundry measured by the measuring head 14. According to FIG. 2, the display device 6 contains a display zone 16. The display zone 16 is divided into a large number of display areas 17, 18, 19, 20, 21, and 22. Each display area 17 to 22 shows items of laundry of a different type of fabric. The embodiment may be such that the number of items of laundry identified by the measuring head 14 for a laundry treatment process is displayed in each display area 17 to 22 for a different type of items of laundry. For example: in display area 20, items of laundry made of synthetic fibers are displayed; in display area 21, items of laundry made of cotton are displayed; in display area 22, items of laundry made of multicolored textiles are displayed; in display area 17, items of white, un-dyed laundry are displayed; etc. According to one particular embodiment, only the type of the material of the identified items of laundry is displayed, but not the number per type of material.

Figure 3:
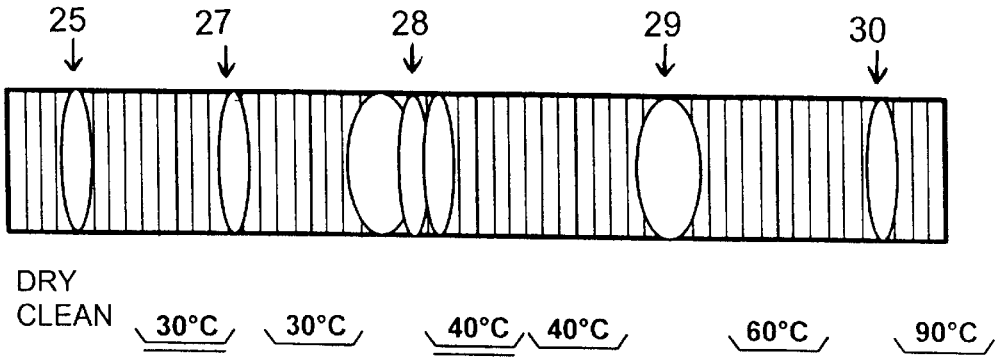
FIG. 3 is a diagram showing clusters indicating a frequency of different types of items of laundry presented to the laundry treatment machine for identification and items that have been identified.

Clusters 25, 27, 28, 29, 30 are formed by the control device 8 and its decision-maker 10, preferably a spectrometer. The formation involves the control device 8 performing a frequency calculation as to how frequently a certain type of laundry was identified, for example, how many items of laundry can be washed at 30° C., how many items of laundry can be washed at 40° C., how many items of laundry can be washed at 60° C., how many items of laundry can be washed at 90° C., and how many can be dry cleaned. An example of a spectrum of these clusters is schematically represented in FIG. 3.

Figure 4:
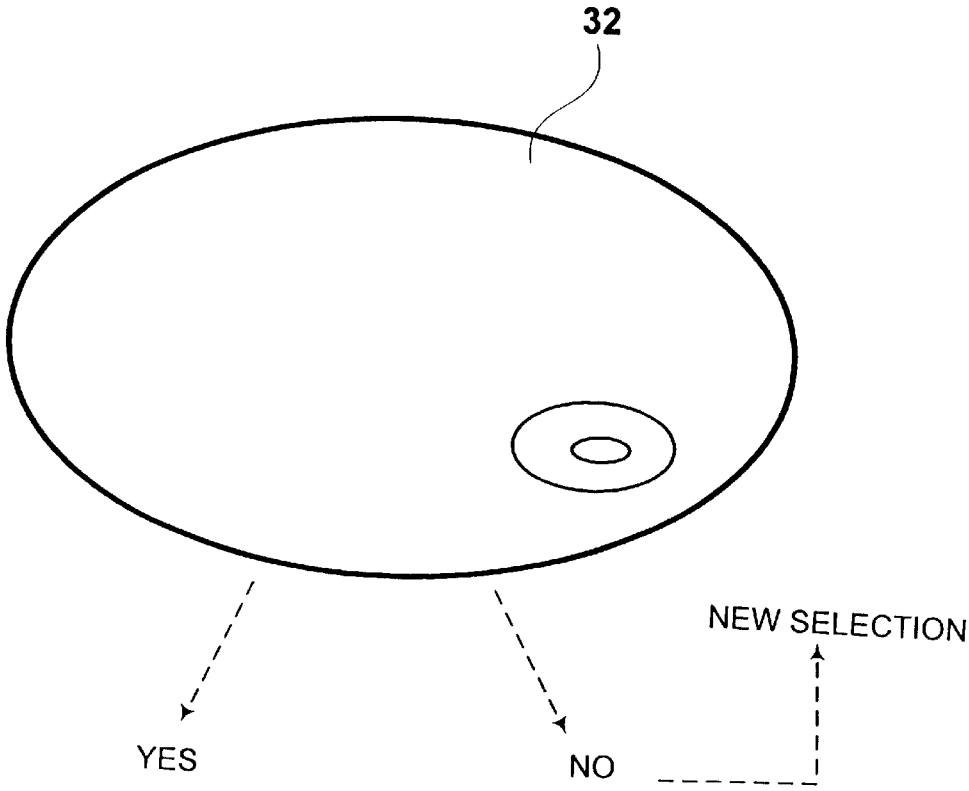
FIG. 4 is a diagrammatic illustration of a display device of the laundry treatment machine according to FIG. 1 with the display zone proposing to an operator a decision on implementing a program.
Figure 5:
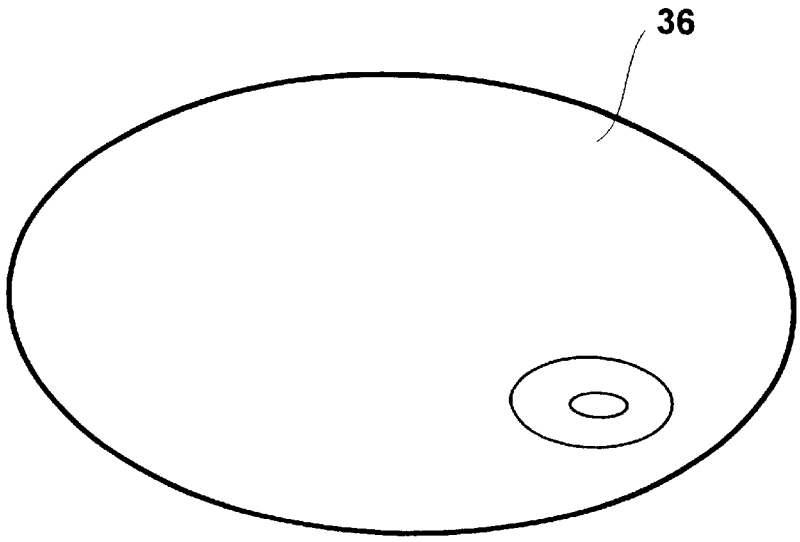
FIG. 5 is a diagrammatic illustration of a display device of the laundry treatment machine according to FIG. 1 with the display zone indicating the currently running program step of the laundry treatment program.

As the next method step after the cluster formation, the control device 8 calculates with its decision-maker 10 a laundry treatment program suitable for the identified items of laundry, for example, a combined washing and drying program. The program is optically displayed for an operator in a display zone 32 of the display device 6, as is represented in FIG. 4 for example. Preferably, a selection or separation from the clusters is carried out based on fuzzy logic principles in the calculation of the laundry treatment program.

For example, the display zone 32 in FIG. 4 indicates the following program proposal: "wash gently at 30° C. for 1½ hours and then dry, okay?"

Thus, the laundry treatment machine makes a proposal to the operator. The operator can acknowledge the program proposal at an operator control element with a "YES" or "NO" response. The operator control element may be provided at the display zone 32 or be contained in the operator control device 7.

If the operator acknowledges the program proposed by the machine with "YES", the proposed program can start automatically or be started manually by actuating an operator control element of the operator control device 7, depending on the embodiment of the control device 8.

For safety reasons, a locking circuit is, of course, provided, allowing a program to be started only when the door 4 of the washing drum is closed. The laundry treatment program then runs.

According to one particular embodiment of the machine, a further display zone 36 may be provided, respectively indicating to an operator the current state of the laundry treatment program, for example "laundry is being dried, ready at 21:12".

The invention offers the operator a cleaning assistant, which assists, if a cleaning process is selected, the laundry treatment program, in particular, a washing program, some other cleaning program, a detergent, a drying program, or the like. The assistant also gives information on the type of the material, in particular, the fibers of the items of laundry. The assistant then makes a proposal for a suitable laundry treatment process.

According to a preferred embodiment, the control device 8 or its decision-maker 10 includes a spectrometer, by which types of material, in particular, textiles, fibers, type of soiling, and amount of soiling of items of laundry are analyzed. From these parameters, the required type of detergent and amount of detergent, and the laundry treatment program to be recommended are then calculated and displayed on the display device 6.

According to one particular embodiment, an optical display of may be replaced by a voice output or be combined with such a voice output. The laundry treatment program proposed by the machine can start once the operator has confirmed the program, either by one or more words spoken by the operator or by a manual acknowledgement at an operator control element, depending on the embodiment of the laundry treatment machine.

According to the preferred embodiment of the invention, active intervention by an operator in the choice of laundry treatment programs also continues to be possible. Such intervention may include, for example, in deliberate acknowledgement by an operator of the program proposed by the machine, in a new selection, or in a manual entry of the degree of soiling of the items of laundry, a changing of the program time, etc.

By having the operator use the measuring head 14 of the spectrometer for consciously ascertaining the type of the items of laundry, the operator is introduced into the area of laundry care in a very easy way. Information concerning the type of materials of the items of laundry gives the operator the possibility, when desired, of increasing his or her knowledge in the area of laundry care. According to a preferred embodiment, the laundry treatment machine may alternatively also be used in a conventional way without activation of the decision-maker 10.

The invention consequently provides an operator-friendly and user-friendly means for a laundry treatment machine that can be integrated in an existing laundry treatment machine or be additionally connected. The invention is a significant step toward a new human-laundry-machine communication and information level.

I claim:

1. A laundry treatment machine, comprising:

an electronic control device for automatic implementation of laundry treatment programs having a decision-making means for identifying a type of each laundry item placed into the laundry treatment machine and making a decision concerning an optimized laundry treatment program of a plurality of laundry treatment programs to be used for treating a combination of the identified laundry items placed into the laundry treatment machine;

information output means for presenting to a user said optimized laundry treatment program as a proposal, said information output means connected to said decision-making means; and input means connected to said electronic control device, said input means to be actuated by a user for confirming said laundry treatment program determined by said decision-making means.

2. The laundry treatment machine according to claim 1, wherein said information output means has an optical display device for optically displaying said optimized laundry treatment program.

3. The laundry treatment machine according to claim 1, wherein said information output means has a voice device for outputting an acoustic announcement of said optimized laundry treatment program in a spoken voice.

4. The laundry treatment machine according to claim 1, wherein said input means includes a selection device modifying said optimized laundry treatment program and executing said modified laundry treatment program.

5. The laundry treatment machine according to claim 1, wherein said input means has a voice input means for entering information to be conveyed by a user through speech to said decision-making means.

6. The laundry treatment machine according to claim 1, wherein said decision-making means selectively sets a stored laundry treatment program and generates a custom laundry treatment program individually adapted to at least one identified laundry item and proposes said custom laundry treatment program to the user.

7. The laundry treatment machine according claim 1, wherein said decision-making means forms clusters based upon a frequency with which a given type of laundry item has been identified for laundry treatment.

8. The laundry treatment machine according to claim 7, wherein said decision-making means forms, from said clusters, a decision as to which of said laundry treatment programs can be used for treating the identified laundry items based on fuzzy logic.

9. The laundry treatment machine according to claim 1, wherein said decision-making means has a measuring head for detecting the laundry items.

10. The laundry treatment machine according to claim 1, including an optical information output device displaying types of the identified laundry items.

11. The laundry treatment machine according to claim 10, wherein said optical information output device separately indicates a number of identified laundry items for each type of laundry item.

12. The laundry treatment machine according to claim 1, wherein:

said decision-making means has a subtraction function for presenting, once again, identified laundry items for further identification and for subtracting the newly identified items of laundry from initially identified laundry items; and said decision-making means performing a new decision-making process following an execution of the subtraction function.

13. The laundry treatment machine according to claim 1, wherein at least one of said electronic control device and said decision-making means stores parameters, and said parameters are to be compared with the identified laundry items.

14. The laundry treatment machine according to claim 1, wherein said decision-making means has a spectrometer for ascertaining a laundry item type.

15. A washing machine for laundry, comprising:

an electronic control device for automatic implementation of laundry treatment programs having a decision-making means for identifying a type of each laundry item placed into the washing machine and making a decision concerning an optimized laundry treatment program of a plurality of laundry treatment programs to be used for treating a combination of the identified laundry items placed into the washing machine;

information output means for presenting to a user said optimized laundry treatment program as a proposal, said information output means connected to said decision-making means; and input means connected to said electronic control device, said input means to be actuated by a user for confirming said laundry treatment program determined by said decision-making means.

16. A drying machine for laundry, comprising:

an electronic control device for automatic implementation of laundry treatment programs having a decision-making means for identifying a type of each laundry item placed into the drying machine and making a decision concerning an optimized laundry treatment program of a plurality of laundry treatment programs to be used for treating a combination of the identified laundry items placed into the drying machine;

information output means for presenting to a user said optimized laundry treatment program as a proposal, said information output means connected to said decision-making means; and input means connected to said electronic control device, said input means to be actuated by a user for confirming said laundry treatment program determined by said decision-making means.

17. A combination washing and drying machine for laundry, comprising:

an electronic control device for automatic implementation of laundry treatment programs having a decision-making means for identifying a type of each laundry item placed into the machine and making a decision concerning an optimized laundry treatment program of a plurality of laundry treatment programs to be used for treating a combination of the identified laundry items placed into the machine;

information output means for presenting to a user said optimized laundry treatment program as a proposal, said information output means connected to said decision-making means; and input means connected to said electronic control device, said input means to be actuated by a user for confirming said laundry treatment program determined by said decision-making means.

18. A laundry treatment machine, comprising:

an electronic control device for automatic implementation of laundry treatment programs having a decision-making device identifying a type of each laundry item placed into the laundry treatment machine and making a decision concerning an optimized laundry treatment program of a plurality of laundry treatment programs to be used for treating a combination of the identified laundry items placed into the laundry treatment machine;

information output device presenting to a user said optimized laundry treatment program as a proposal, said information output device connected to said decision-making device; and input device connected to said electronic control device, said input device to be actuated by a user for confirming said laundry treatment program determined by said decision-making device.

19. The laundry treatment machine according to claim 18, wherein said information output device has an optical display device optically displaying said optimized laundry treatment program.

20. The laundry treatment machine according to claim 18, wherein said information output device has a voice device outputting an acoustic announcement of said optimized laundry treatment program in a spoken voice.

21. The laundry treatment machine according to claim 18, wherein said input device includes a selection device modifying said optimized laundry treatment program and executing said modified laundry treatment program.

22. The laundry treatment machine according to claim 18, wherein said input device has a voice input device receiving speech information to be conveyed by a user and entering the speech information to said decision-making device.

23. The laundry treatment machine according to claim 18, wherein said decision-making device selectively sets a stored laundry treatment program and generates a custom laundry treatment program individually adapted to at least one identified laundry item and proposes said custom laundry treatment program to the user.

24. The laundry treatment machine according claim 18, wherein said decision-making device forms clusters based upon a frequency with which a given type of laundry item has been identified for laundry treatment.

25. The laundry treatment machine according to claim 24, wherein said decision-making device forms, from said clusters, a decision as to which of said laundry treatment programs can be used for treating the identified laundry items based on fuzzy logic.

26. The laundry treatment machine according to claim 18, wherein said decision-making device has a measuring head detecting the laundry items.

27. The laundry treatment machine according to claim 18, including an optical information output device displaying types of the identified laundry items.

28. The laundry treatment machine according to claim 27, wherein said optical information output device separately indicates a number of identified laundry items for each type of laundry item.

29. The laundry treatment machine according to claim 18, wherein:

said decision-making device has a subtraction function subtracting at least one identified laundry item from initially identified laundry items and presenting, once again, further identified laundry items for further identification; and said decision-making device performing a new decision-making process following an execution of the subtraction function.

30. The laundry treatment machine according to claim 18, wherein at least one of said electronic control device and said decision-making device stores parameters, and said parameters are to be compared with the identified laundry items.

31. The laundry treatment machine according to claim 18, wherein said decision-making device has a spectrometer ascertaining a laundry item type.

32. A washing machine for laundry, comprising:

an electronic control device for automatic implementation of laundry treatment programs having a decision-making device identifying a type of each laundry item placed into the washing machine and making a decision concerning an optimized laundry treatment program of a plurality of laundry treatment programs to be used for treating a combination of the identified laundry items placed into the washing machine;

information output device presenting to a user said optimized laundry treatment program as a proposal, said information output device connected to said decision-making device; and input device connected to said electronic control device, said input device to be actuated by a user for confirming said laundry treatment program determined by said decision-making device.

33. A drying machine for laundry, comprising:

an electronic control device for automatic implementation of laundry treatment programs having a decision-making device identifying a type of each laundry item placed into the drying machine and making a decision concerning an optimized laundry treatment program of a plurality of laundry treatment programs to be used for treating a combination of the identified laundry items placed into the drying machine;

information output device presenting to a user said optimized laundry treatment program as a proposal, said information output device connected to said decision-making device; and input device connected to said electronic control device, said input device to be actuated by a user for confirming said laundry treatment program determined by said decision-making device.

34. A combination washing and drying machine for laundry, comprising:

an electronic control device for automatic implementation of laundry treatment programs having a decision-making device identifying a type of each laundry item placed into the machine and making a decision concerning an optimized laundry treatment program of a plurality of laundry treatment programs to be used for treating a combination of the identified laundry items placed into the machine;

information output device presenting to a user said optimized laundry treatment program as a proposal, said information output device connected to said decision-making device; and input device connected to said electronic control device, said input device to be actuated by a user for confirming said laundry treatment program determined by said decision-making device.

* * * * *